US008851967B2

(12) United States Patent
Arnone et al.

(10) Patent No.: US 8,851,967 B2
(45) **Date of Patent: *Oct. 7, 2014**

(54) SKILL CALIBRATED HYBRID GAME

(71) Applicant: Gamblit Gaming, LLC, Glendale, CA (US)

(72) Inventors: Miles Arnone, Sherborn, MA (US); Eric Meyerhofer, Pasadena, CA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/161,230

(22) Filed: Jan. 22, 2014

(65) Prior Publication Data

US 2014/0135103 A1 May 15, 2014

Related U.S. Application Data

(63) Continuation of application No. 13/935,410, filed on Jul. 3, 2013, now Pat. No. 8,657,660, which is a continuation of application No. PCT/US2012/065922, filed on Nov. 19, 2012.

(60) Provisional application No. 61/629,438, filed on Nov. 19, 2011.

(51) Int. Cl.
*G07F 17/32* (2006.01)
*A63F 9/24* (2006.01)

(52) U.S. Cl.
CPC ..... *G07F 17/3244* (2013.01); *G07F 17/326* (2013.01); *A63F 9/24* (2013.01); *G07F 17/32* (2013.01)
USPC ..... 463/16

(58) Field of Classification Search
USPC ..... 463/16
See application file for complete search history.

(56) References Cited

U.S. PATENT DOCUMENTS 5,413,357 A 5/1995 Schulze et al.
5,718,429 A 2/1998 Keller (Continued)

FOREIGN PATENT DOCUMENTS

JP 2001300098 A 10/2001
JP 2003111980 A 4/2003

(Continued)

OTHER PUBLICATIONS

WIPO/IPEA International Preliminary Report on Patentability, PCT/US12/65922, Aug. 30, 2013.

(Continued)

*Primary Examiner* — Corbett B Coburn
(74) *Attorney, Agent, or Firm* — Frank Cire

(57) ABSTRACT

Systems and methods in accordance with embodiments of the invention operate a networked system for a skill calibrated hybrid game that includes: a gambling game; an entertainment game; a game world engine constructed to manage the entertainment game and communicate gameplay gambling event occurrences based upon a player's skillful execution of the entertainment game that trigger a wager in the gambling game; and a skill calibration module constructed to: receive player data for a player, where the player data is indicative of a player's gameplay performance at the entertainment game; analyze the player data to determine a player's skill level; determine whether the terms of a wager of a gambling game are calibrated in a manner appropriate to the player's skill level; and send a command during play of the skill calibrated hybrid game that causes the real world engine to calibrate the terms of a wager in the gambling game.

20 Claims, 7 Drawing Sheets

(56) References Cited

U.S. PATENT DOCUMENTS 5,785,592 A 7/1998 Jacobsen
6,050,895 A 4/2000 Luciano
6,227,974 B1 5/2001 Eilat
6,267,669 B1 7/2001 Luciano
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0234791 A1 10/2006 Nguyen et al.
2006/0258433 A1 11/2006 Finocchio et al.
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0117641 A1 5/2007 Walker et al.
2007/0129149 A1 6/2007 Walker
2007/0156509 A1 7/2007 Jung et al.
2007/0167212 A1 7/2007 Nguyen
2007/0167239 A1 7/2007 O'Rourke
2007/0191104 A1 8/2007 Van Luchene
2007/0203828 A1 8/2007 Jung et al.
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108425 A1 5/2008 Oberberger
2008/0119283 A1 5/2008 Baerlocher
2008/0146308 A1 6/2008 Okada
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0082093 A1 3/2009 Okada
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0176560 A1 7/2009 Herrmann et al.
2009/0176566 A1 7/2009 Kelly
2009/0221355 A1 9/2009 Dunaevsky et al.
2009/0247272 A1 10/2009 Abe
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0035674 A1 2/2010 Slomiany
2010/0056247 A1 3/2010 Nicely
2010/0062836 A1 3/2010 Young
2010/0093420 A1 4/2010 Wright
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0077087 A1 3/2011 Walker et al.
2011/0082571 A1 4/2011 Murdock et al.
2011/0109454 A1 5/2011 McSheffrey
2011/0111837 A1 5/2011 Gagner

(56) References Cited

U.S. PATENT DOCUMENTS

| | | | |
|---|---|---|---|
| 2011/0118011 | A1 | 5/2011 | Filipour et al. |
| 2011/0201413 | A1 | 8/2011 | Oberberger |
| 2011/0207523 | A1 | 8/2011 | Filipour et al. |
| 2011/0212766 | A1 | 9/2011 | Bowers et al. |
| 2011/0212767 | A1 | 9/2011 | Barclay |
| 2011/0218028 | A1 | 9/2011 | Acres |
| 2011/0218035 | A1 | 9/2011 | Thomas |
| 2011/0230258 | A1 | 9/2011 | Van Luchene |
| 2011/0230260 | A1 | 9/2011 | Morrow et al. |
| 2011/0244944 | A1 | 10/2011 | Baerlocher |
| 2011/0263312 | A1 | 10/2011 | De Waal |
| 2011/0269522 | A1 | 11/2011 | Nicely et al. |
| 2011/0275440 | A1 | 11/2011 | Faktor |
| 2011/0287828 | A1 | 11/2011 | Anderson et al. |
| 2011/0287841 | A1 | 11/2011 | Watanabe |
| 2011/0312408 | A1 | 12/2011 | Okuaki |
| 2012/0058814 | A1 | 3/2012 | Lutnick |
| 2012/0077569 | A1 | 3/2012 | Watkins |
| 2012/0108323 | A1 | 5/2012 | Kelly |
| 2012/0202587 | A1 | 8/2012 | Allen |
| 2012/0322545 | A1 | 12/2012 | Arnone et al. |

FOREIGN PATENT DOCUMENTS

| | | | |
|---|---|---|---|
| JP | 2004097610 | A | 4/2004 |
| JP | 2004166746 | A | 6/2004 |
| WO | 9851384 | A1 | 11/1998 |
| WO | 2010087090 | A1 | 8/2010 |
| WO | 2012139083 | A1 | 10/2012 |
| WO | 2013059308 | A1 | 4/2013 |
| WO | 2013075129 | A1 | 5/2013 |
| WO | 2013075135 | A1 | 5/2013 |

OTHER PUBLICATIONS itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.

Changing the Virtual Self: Avatar Transformations in Popular Games; Barr et al., Victoria Univ., NZ, 2006.

Real-Time Multimodal Human—Avatar Interaction; Li et al., IEEE (Video Technology) vol. 18, No. 4, 2008.

U.S. Appl. No. 13/854,658, Arnone, et al., filed Apr. 1, 2013.

U.S. Appl. No. 13/855,676, Arnone, et al., filed Apr. 2, 2013.

U.S. Appl. No. 13/872,946, Arnone, et al., filed Apr. 29, 2013.

U.S. Appl. No. 13/886,245, Arnone, et al., filed May 2, 2013.

U.S. Appl. No. 13/888,326, Arnone, et al., filed May 6, 2013.

U.S. Appl. No. 13/890,207, Arnone, et al., filed May 8, 2013.

U.S. Appl. No. 13/896,783, Arnone, et al., filed May 17, 2013.

U.S. Appl. No. 13/898,222, Arnone, et al., filed May 20, 2013.

U.S. Appl. No. 13/900,363, Arnone, et al., filed May 22, 2013.

U.S. Appl. No. 13/903,895, Arnone, et al., filed May 28, 2013.

U.S. Appl. No. 13/917,513, Arnone, et al., filed Jun. 13, 2013.

U.S. Appl. No. 13/917,529, Arnone, et al., filed Jun. 13, 2013.

U.S. Appl. No. 13/920,031, Arnone, et al., filed Jun. 17, 2013.

U.S. Appl. No. 13/928,166, Arnone, et al., filed Jun. 26, 2013.

International Search Report and Written Opinion, PCT/US2012/65922, Feb. 5, 2013.

SKILL CALIBRATED HYBRID GAME

CROSS REFERENCE TO RELATED APPLICATIONS

This application is a continuation U.S. patent application Ser. No. 13/935,410, filed on Jul. 3, 2013, which is a continuation of Patent Cooperation Treaty Application No. PCT/US12/65922, filed Nov. 19, 2012, which claims the benefit of U.S. Provisional Application No. 61/629,438 filed Nov. 19, 2011 and is related to PCT patent application PCT/US11/26768, filed Mar. 1, 2011, U.S. Provisional Patent Application 61/459,131, filed Dec. 6, 2010, and U.S. Provisional Patent Application 61/460,362, filed Dec. 31, 2010, U.S. Provisional Patent Application 61/516,693, filed Apr. 6, 2011, U.S. Provisional Patent Application entitled Enriched Table Top Game Play Environment (Single Or Multi-Player) For Casino Applications filed Sep. 30, 2011, U.S. Provisional Patent Application entitled ANTI-SANDBAGGING IN ENRICHED GAME PLAY ENVIRONMENT (SINGLE AND/OR MULTI-PLAYER) FOR CASINO APPLICATIONS filed Oct. 17, 2011, U.S. Provisional Patent Application entitled SKILL-LEVELING IN ENRICHED GAME PLAY ENVIRONMENT (SINGLE AND/OR MULTI-PLAYER) FOR CASINO APPLICATIONS filed Oct. 17, 2011, and U.S. Provisional Patent Application entitled HEAD-TO-HEAD AND TOURNAMENT PLAY FOR ENRICHED GAME PLAY ENVIRONMENT (SINGLE AND/OR MULTI-PLAYER) FOR CASINO APPLICATIONS filed Oct. 17, 2011 the contents of each of which are hereby incorporated by reference as if stated in full herein.

FIELD OF THE INVENTION

Embodiments of the present invention are generally related to gaming and more specifically to a skill calibrated hybrid game that includes both an entertainment game and a gambling game with wager terms in the gambling game calibrated to the skill level of a player of the entertainment game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY OF THE INVENTION

Systems and methods in accordance with embodiments of the invention operate a skill calibrated hybrid game. One embodiment includes a skill calibrated hybrid game, including: a real world engine constructed to provide a randomly generated payout of real world credits from at least one wager in a gambling game; an entertainment software engine constructed to execute an entertainment game providing outcomes upon a player's skillful execution of the entertainment game to earn game world credits, and manage a user interface of the entertainment game; a game world engine constructed to manage the entertainment software engine and communicate gameplay gambling event occurrences based upon a player's skillful execution of the entertainment game that trigger at least one wager in the gambling game to the gambling game; and where the game world engine utilizes a skill calibration module, and the skill calibration module is constructed to: receive player data for at least one player, where the player data is indicative of a player's gameplay performance at the entertainment game; analyze the player data to determine a player's skill level; determine whether the terms of at least one wager of a gambling game are calibrated in a manner appropriate to the player skill level; and send a command to the real world engine during play of the skill calibrated hybrid game that causes the real world engine to calibrate the terms of at least one wager in the gambling game.

In a further embodiment, the skill calibration module is constructed to record adjustments to the calibration of the terms of the at least one wager in the gambling game in a calibration history.

In another embodiment, the information relating to calibrating the terms of at least one wager in the gambling game includes metadata that enables the information to be utilized in a future determination of the appropriate calibration for the terms of the at least one wager of the gambling game.

In a still further embodiment, the command to calibrate the terms of at least one wager is sent only when notification that at least one player that the calibration is applied to accepts the calibration is received by the entertainment game user interface.

In still another embodiment, play of the skill calibrated hybrid game ends when notification that at least one player that the calibration is applied to does not accept the calibration is received by the entertainment game user interface.

In a yet further embodiment, the player data is analyzed during play to determine a player's skill level;

In yet another embodiment, the skill calibration module is constructed to communicate with the game world engine via a network.

In a further embodiment again, the terms of at least one wager are calibrated such that more wagers are performed for a given period of time for a higher skilled player than for a lower skilled player.

In another embodiment again, the terms of at least one wager are calibrated such that more real world credits are wagered per wager for a higher player skill level than for a lower player skill level.

In a further additional embodiment, the terms of at least one wager are calibrated by adding an amount of real world credits that is a multiple of a discrete number that represents at least one player's skill level to the amount of real world credits wagered in each wager.

Another additional embodiment includes a method of operating a skill calibrated hybrid game, the method including: receiving player data indicative of at least one player's gameplay performance at the skill calibrated hybrid game using a skill calibration module incorporated with a game world engine, where the game world engine is constructed to communicate gameplay gambling event occurrences based upon a player's skillful execution of an entertainment game to earn game world credits as detected by an entertainment software engine that triggers at least one wager in a gambling game to the gambling game including a real world engine constructed to provide at least one wager as a randomly generated payout of real world credits for the gambling game; analyzing the player data for at least one player using the skill calibration module utilized by the game world engine to determine a player's skill level; determining whether the terms of at least one wager of a gambling game are calibrated in a manner appropriate to the player skill level using the skill calibration module; and sending a command to the real world engine during play of the skill calibrated hybrid game that causes the real world engine to calibrate the terms of at least one wager in the gambling game using the skill calibration module.

In a still yet further embodiment, the skill calibration module is constructed to record adjustments to the calibration of the terms of the at least one wager in the gambling game in a calibration history.

In still yet another embodiment, the information relating to calibrating the terms of at least one wager in the gambling game includes metadata that enables the information to be utilized in a future determination of the appropriate calibration for the terms of the at least one wager of the gambling game.

In a still further embodiment again, the command to calibrate the terms of at least one wager is sent only when notification that at least one player that the calibration is applied to accepts the calibration is received by the entertainment game user interface.

In another embodiment again, play of the skill calibrated hybrid game ends when notification that at least one player that the calibration is applied to does not accept the calibration is received by the entertainment game user interface.

In a still further additional embodiment, the player data is analyzed during play to determine a player's skill level.

In still another additional embodiment, the terms of at least one wager are calibrated such that more wagers are performed for a given period of time for a higher skilled player than for a lower skilled player.

In a yet further embodiment again, the terms of at least one wager are calibrated such that more real world credits are wagered per wager for a higher player skill level than for a lower player skill level.

In yet another embodiment again, the terms of at least one wager are calibrated by adding an amount of real world credits that is a multiple of a discrete number that represents at least one player's skill level to the amount of real world credits wagered in each wager.

A yet further additional embodiment includes a machine readable medium containing processor instructions, where execution of the instructions by a processor causes the processor to perform a process including: receiving player data indicative of at least one player's gameplay performance at a skill calibrated hybrid game using a skill calibration module utilized by a game world engine, where the game world engine is constructed to communicate gameplay gambling event occurrences based upon a player's skillful execution of an entertainment game to earn game world credits as detected by an entertainment software engine that triggers at least one wager in a gambling game to the gambling game including a real world engine constructed to provide at least one wager as a randomly generated payout of real world credits for the gambling game; analyzing the player data for at least one player using the skill calibration module to determine a player's skill level; determining whether the terms of at least one wager of a gambling game are calibrated in a manner appropriate to the player skill level using the skill calibration module; and sending a command to the real world engine during play of the skill calibrated entertainment game that causes the real world engine to calibrate the terms of at least one wager in the gambling game using the skill calibration module.

DETAILED DESCRIPTION

Figure 1:
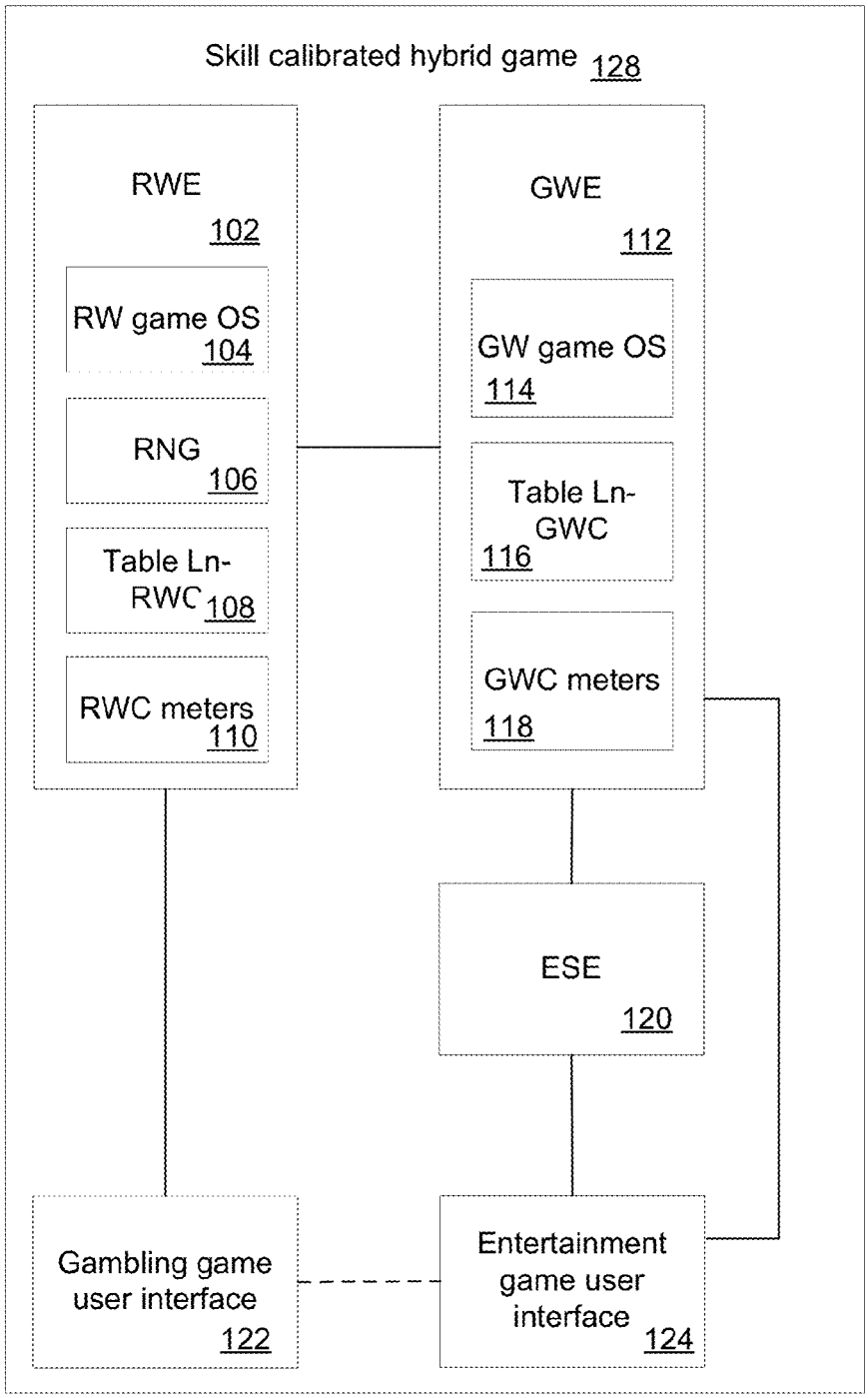
FIG. 1 illustrates a skill calibrated hybrid game in accordance with an embodiment of the invention.

Turning now to the drawings, systems and methods for operation of a skill calibrated hybrid game are illustrated. In several embodiments, a skill calibrated hybrid game is a form of a hybrid game that integrates both a gambling game that includes a real world engine (RWE) which manages the gambling game, as well as an entertainment game that includes a game world engine (GWE) which manages the entertainment portion of a game, and an entertainment software engine (ESE) which executes the entertainment game for user entertainment. In certain embodiments, the skill calibrated hybrid game also includes a user interface associated with either or both the gambling game and the entertainment game. In operation of a skill calibrated hybrid game, a player acts upon various types of elements of the entertainment game in a game world environment. Upon acting on some of these elements, a wager is triggered in the gambling game. In playing the entertainment game, using the elements, a player can consume and accrue game world credits (GWC) within the entertainment game. These credits can be in the form of (but are not limited to) game world objects, experience points, or points generally. Wagers are made in the gambling game using real world credits (RWC). The real world credits can be credits in an actual currency, or may be credits in a virtual currency which has real world value. Gambling outcomes from the gambling game may cause consumption, loss or accrual of RWC. In addition, gambling outcomes in the gambling game may influence elements in the entertainment game such as (but not limited to) by restoring a consumed element, causing the loss of an element, restoration or placement of a fixed element. Example elements include enabling elements (EE) which are elements that enable a player's play of the entertainment game and whose consumption by the player while playing the entertainment game may trigger a wager in a gambling game. In addition, EE may also be replenished during play within the entertainment game based on an outcome of a triggered wager. Other types of elements include actionable elements (AE) which are elements that are acted upon to trigger a wager in the gambling game and may not be restorable during normal play of the entertainment game. Various hybrid games are discussed in Patent Cooperation Treaty Application No. PCT/US11/26768, filed Mar. 1, 2011, entitled "ENRICHED GAME PLAY ENVIRONMENT (SINGLE and/or MULTI-PLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety.

In many embodiments, a skill calibrated hybrid game assesses a player's skill level at the entertainment game to calibrate the particular terms of wagers (or wager terms) made in a gambling game. A player's skill level can be an assessed level of skill at an entertainment game which can be based upon a discrete ranking of skill levels (such as but not limited to relative levels such as beginner, intermediate or advanced) or based upon skill based achievements (such as but not limited to achieving a certain race completion time in a racing game).

In numerous embodiments, wager terms dictate the conditions defining the wager, while the execution of a wager in the gambling game is determined by chance and independent of player skill. Calibration of the wager terms can be made in any manner such as but not limited to by scaling wagers based upon the skill level of a player or increasing or decreasing the odds, range of possible outcomes, amount wagered, and frequency of wagers or availability of bonus rounds. Thereby, a skill calibrated hybrid game can provide a gambling game calibrated to the player's skill level for an appropriate gambling game experience.

In many embodiments, a player of a skill calibrated hybrid game is able to choose whether the calibrations are applied. If the player chooses to not apply the calibrations, then the gameplay session of the skill calibrated entertainment game can either continue without calibration or ends.

Skill calibrated hybrid games in accordance with embodiments of the invention are discussed below.

Skill Calibrated Hybrid Games

In many embodiments, a skill calibrated hybrid game integrates high levels of entertainment content with a game of skill (entertainment game), a gambling experience with a game of chance (gambling game). A skill calibrated hybrid game provides for random outcomes independent of player skill while providing that the user's gaming experience (as measured by obstacles/challenges encountered, time of play and other factors) is shaped by the player's skill. Thereby, wagers made as random outcomes independent of player skill in a gambling game can have their terms calibrated to a player's skill level within the entertainment game. A skill calibrated hybrid game in accordance with an embodiment of the invention is illustrated in FIG. 1. The skill calibrated hybrid game 128 includes a RWE 102, GWE 112, ESE 120, gambling game user interface 122 and entertainment game user interface 124. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In several embodiments, the RWE 102 is the operating system for the gambling game of the skill calibrated hybrid game 128 and controls and operates the gambling game. The operation of a gambling game is enabled by RWC, such as money or other real world funds. A gambling game can increase or decreases an amount of RWC based on random gambling outcomes, where the gambling proposition of a gambling game is typically regulated by gaming control bodies. In many embodiments, the RWE includes a RW operating system (OS) 104, random number generator (RNG) 106, level "n" real-world credit pay tables (Table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level "n" real-world credit pay table (Table Ln-RWC) 108 is a table that can be used in conjunction with a random number generator (RNG) 106 to dictate the real world credits (RWC) earned as a function of gameplay and is analogous to the pay tables used in a conventional slot machine. Table Ln-RWC payouts are independent of player skill. There may be one or a plurality of Table Ln-RWC pay tables 108 contained in a gambling game, the selection of which may be determined by factors including (but not limited to) game progress a player has earned, and/or bonus rounds which a player may be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be required to enter higher ESE game levels. RWC can be carried forward to higher game levels or paid out if a cash out is opted for by a player. The amount of RWC required to enter a specific level of the game "level n" need not be the same for each level.

In many embodiments, the GWE 112 manages the overall skill calibrated hybrid game operation, with the RWE 102 and the ESE 120 effectively being support units to the GWE 112. In several embodiments, the GWE 112 contains mechanical, electronic and software system for an entertainment game. The GWE 112 includes a GW game operating system (OS) 114 that provides control of the entertainment game. The GWE additionally contains a level "n" game world credit pay table (Table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120. The GWE can also implement various skill calibrated modules designed to calibrate wager terms in a gambling game to a player's skill level.

In many embodiments, a level "n" game world credit pay table (Table Ln-GWC) 116 dictates the GWC earned as a function of player skill in the nth level of the game. The payouts governed by this table are dependent upon player skill and gameplay at large and may or may not be coupled to a random number generator. In several embodiments, game world credits (GWC) are player points earned or depleted as a function of player skill, i.e. as a function of player performance in the context of the game. GWC is analogous to the "score" in a typical video game. Each entertainment game has one or more scoring criterion, embedded within the Table Ln-GWC 116 that reflects player performance against the goal(s) of the game. GWC can be carried forward from one level of gameplay to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE does not affect the RWE's gambling operation except for player choice parameters that are allowable in slot machines today including but not limited to the wager amount, how fast the player wants to play (by pressing a button or pulling the slot's handle) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a necessary status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this may be necessary to communicate certain entertainment game club points, player status, control the selection of choices and messages which a player may find useful in order to adjust their entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In numerous embodiments, an ESE can be an electromechanical game system of a skill calibrated hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 may send certain GW game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements may be based on a gambling outcome of a gambling game that was triggered by an element in the entertainment game being acted upon by the player. The ESE 120 can accept this input from the GWE 112, make adjustments, and continue the play action all the while running seamlessly from the player's perspective. The ESE's operation is mostly skill based, except for where the ESE's processes may inject complexities into the game by chance in its normal operation to create unpredictability in the entertainment game. Utilizing this interface, the ESE 120 may also communicate player choices made in the game to the GWE 112, such as but not limited to selection of a different gun, and/or the player picking up a special potion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In a particular embodiment, the RWE 102 operation can be a game of chance as a gambling game running every 10 seconds where the amount wagered is communicated from the GWE 112 as a function of choices the player makes in the operation profile in the entertainment game such as those cited above.

In many embodiments, a skill calibrated hybrid game integrates a video game style gambling machine, where the gambling game (i.e. RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time a rich environment of rewards to stimulate "garners" can be established with the entertainment game. In several embodiments, the skill calibrated hybrid game can leverage very popular titles with "garners" and provides a sea change environment for casinos to attract players with games that are more akin to the type of entertainment which a younger generation desires. In various embodiments, players can use their skill towards building and banking GWC which in turn can be used to win tournaments and various prizes as a function of their "gamer" prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In certain embodiments, skill calibrated hybrid games also allow players to gain entry into subsequent competitions through the accumulation of game world credits (GWC) that accrue as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In many embodiments, one or more players engage in playing an entertainment game, resident in the ESE, the outcomes of which are dependent at least in part on skill. The skill calibrated hybrid game can include an entertainment game that includes head-to-head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

In many embodiments, if an entertainment game includes a version of Madden Football™ a player can bet on whether or not the player is going to beat the computer, or if the player is playing against another player, that other player. These bets can be made, for example, on the final outcome of the game, and/or the state of the game along various intermediary points (such as but not limited to the score at the end of the 1st quarter) and/or on various measures associated with the game (such as but not limited to the total offensive yards, number of turnovers, or number of sacks). Players can bet against one another, or engage the computer in a head-to-head competition in the context of their skill level in the entertainment game in question. As such, players can have a handicap associated with their player profile that describes their skill (which can be their "professed skill" in certain embodiments), and which is used by a GWE (such as a local GWE or a GWE that receives services from remote servers) to offer appropriate bets around the final and/or intermediate outcomes of the entertainment game, and/or to condition gameplay as a function of player skill, and/or to select players across one or more skill calibrated hybrid games to participate in head to head games and/or tournaments.

Many embodiments enable the maximization of the number of players able to compete competitively by utilizing a skill normalization module. Handicapping enables players of varying performance potential to compete competitively regardless of absolute skill level, such as but not limited to where a player whose skill level identifies the player as a beginner can compete in head-to-head or tournament play against a highly skilled player with meaningful results.

In several embodiments, wagers can be made among numerous skill calibrated hybrid games with a global betting manager (GBM). The GBM is a system that coordinates wagers that are made across multiple skill calibrated hybrid games by multiple players. In some implementations it can also support wagers by third parties relative to the in game performance of other players. The GBM can stand alone, or is capable of being embedded in one of a number of systems, including a GWE, ESE or any remote server capable of providing services to a skill calibrated hybrid game, or can operate independently on one or a number of servers on-site at a casino, as part of a larger network and/or the internet or "cloud" in general. The GBM also supports the management of lottery tickets issued as a function of gameplay.

In many embodiments, third parties that are not playing a hybrid game may want to view and/or wager on entertainment game play. A GWE may relay information to a non-player interface for third parties to gather information concerning entertainment game play. In embodiments where the entertainment game is a fighting game, third parties may want to witness the movements of the game characters rather than simply the outcome of a fight. Therefore, the GWE can transmit information not only to the entertainment game user interface, but also to a non-player interface.

In various embodiments, a third party can see only select information about the gameplay and players on a non-player interface. This information can include (but is not limited to) patron information, EE values, GWC, RW wagers or any other information that can be transmitted to the GW user interface. For instance, the entertainment gameplay information may be visible to third parties on a non-player interface, but not information concerning the wagers a player is making in a gambling game of the skill calibrated hybrid game. Alternatively, in a shooter game, the third parties may be able to see how much health each player has remaining, but has no information about how much ammunition each player has.

In a number of embodiments, a non-player interface can include information that is not directly related to the entertainment game play of a particular skill calibrated hybrid game. This information can include, but is not limited to, the number of players betting on the entertainment game play, side-bets available, or leader-boards. Information available to a non-player interface may or may not be also visible in an entertainment game user interface.

Figure 2:
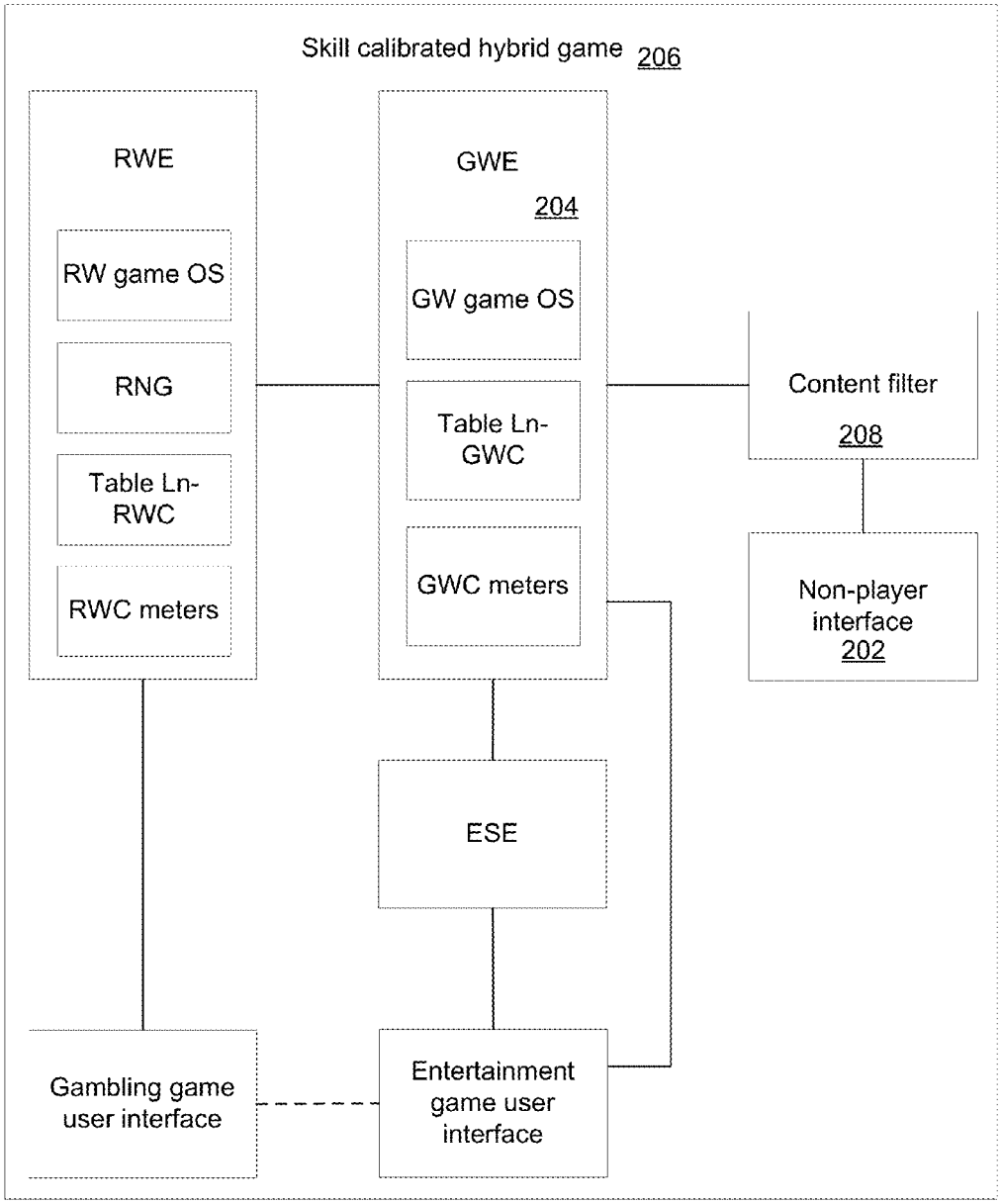
FIG. 2 illustrates a skill calibrated hybrid game with a non-player interface in accordance with an embodiment of the invention.

A hybrid game utilizing a non-player interface is illustrated in FIG. 2. The non-player interface 202 communicates with the GWE 204 of a skill calibrated hybrid game 206 to display information relating to entertainment game play through a content filter 208. The content filter can determine what information is accessible to the non-player interface 202, such as (but not limited to) whether the non-player interface 202 can see the gameplay progress of all or only some of the players.

Although various components of skill calibrated hybrid games are discussed above, skill calibrated hybrid games can be configured with any component appropriate to the requirements of a specific application in accordance with embodiments of the invention. Network connected skill calibrated hybrid games are discussed below.

Network Connected Skill Calibrated Hybrid Games

Skill calibrated hybrid games in accordance with many embodiments of the invention can operate locally while being network connected to draw services from remote locations or to communicate with other skill calibrated hybrid games. In many embodiments, operations associated with a skill calibrated hybrid game such as (but not limited to) processes for calculating score or RWC and GWC tracking can be performed across multiple devices. These multiple devices can be implemented using a single server or a plurality of servers such that a skill calibrated hybrid game is executed as a system in a virtualized space, such as (but not limited to) where the RWE and GWE are large scale centralized servers "in the cloud" coupled to a plurality of widely distributed ESE controllers or clients via the Internet.

In many embodiments, an RWE server can perform certain functionalities of a RWE of a skill calibrated hybrid game. In certain embodiments, a RWE server includes a centralized odds engine which can generate random outcomes (such as but not limited to win/loss outcomes) for a gambling game, thereby eliminating the need to have that functionality of the RWE performed locally within the skill calibrated hybrid game. The RWE server can perform a number of simultaneous or pseudo-simultaneous runs in order to generate random outcomes for a variety of odds percentages that one or more networked skill calibrated hybrid games may require. In certain embodiments, an RWE of a skill calibrated hybrid game can send information to a RWE server including (but not limited to) Table Ln-RWC tables, maximum speed of play for a gambling game, gambling game monetary denominations or any promotional RWC provided by the operator of the skill calibrated hybrid game. In particular embodiments, a RWE server can send information to a RWE of a skill calibrated hybrid game including (but not limited to) RWC used in the gambling game, player account information or play activity and a profile associated with a player.

In several embodiments, a GWE server can perform the functionality of the GWE across various skill calibrated hybrid games. These functionalities can include (but are not limited to) providing a method for monitoring high scores on select groups of games, linking groups of games in order to join them in head-to-head tournaments, and acting as a tournament manager. A GWE server can also execute skill calibrated modules that calibrate wager terms in a gambling game to player skill level in an entertainment game.

In a variety of embodiments, management of player account information can be performed by a GWE patron management server separate from a GWE server. A GWE patron management server can manage player account information, including (but not limited to) data concerning players' characters, players' game scores, players' RWC and GWC and managing tournament reservations. Although a GWE patron management server is discussed separate from a GWE server, in certain embodiments a GWE server also performs the functions of a GWE patron management server. In certain embodiments, a GWE of a skill calibrated hybrid game can send information to a GW patron management server including (but not limited to) GWC and RWC used in a game, player account information, play activity and profile information for players and synchronization information between a gambling game and an entertainment game or other aspects of a skill calibrated hybrid game. In particular embodiments, a GW patron management server can send information to a GWE of a skill calibrated hybrid game including (but not limited to) entertainment game title and type, tournament information, Table Ln-GWC tables, special offers, character or profile setup and synchronization information between a gambling game and an entertainment game or other aspects of a skill calibrated hybrid game.

In numerous embodiments, an ESE server provides a host for managing head-to-head play, operating on the network of ESEs which are connected to the ESE server by providing an environment where players can compete directly with one another and interact with other players. Although an ESE server is discussed separate from a GWE server, in certain embodiments a GWE server also performs the functions of an ESE server.

Servers connected via a network to implement skill calibrated hybrid games in accordance with many embodiments of the invention can communicate with each other to provide services utilized within a skill calibrated hybrid game. In several embodiments a RWE server can communicate with a GWE server. A RWE server can communicate with a GWE server to communicate any type of information as appropriate for a specific application, including (but not limited to): configure the various simultaneous or pseudo simultaneous odds engines executing in parallel within the RWE to accomplish the skill calibrated hybrid game system requirements, determine metrics of RWE performance such as random executions run and outcomes for tracking system performance, perform audits, provide operator reports, and request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server such as the management of a skill calibrated hybrid game tournament. Typically a GWE (such as a GWE that runs within a skill calibrated hybrid game or on a GWE server) is not aware of the relationship of itself to the rest of a tournament since in a typical configuration the actual tournament play is managed by the ESE server. Therefore, management of a skill calibrated hybrid game tournament can include (but is not limited to) tasks such as: conducting tournaments according to system programming that can be coordinated by an operator of the skill calibrated hybrid game; allowing entry of a particular player into a tournament; communicating the number of players in a tournament and the status of the tournament (such as but not limited to the amount of surviving players, their status within the game, time remaining on the tournament); communicating the status of an ESE contained in a game; communicating the performance of its players within the tournament; communicating the scores of the various members in the tournament; and providing a synchronizing link to connect the GWEs in a tournament, with their respective ESE's.

In several embodiments a GWE server can communicate with a GW patron server. A GWE server can communicate with a GW patron server to communicate any type of information as appropriate for a specific application, including (but not limited to) information for configuring tournaments according to system programming conducted by an operator of a skill calibrated hybrid game, exchange of data necessary to link a player's profile to their ability to participate in various forms of gameplay (such as but not limited to the difficulty of play set by the GWE server or the GWE in the game they are playing on), determining a player's ability to participate in a tournament as a function of a player's characteristics (such as but not limited to a player's gaming prowess or other metrics used for tournament screening), configuring the game contained GWE and ESE performance to suit preferences of a player on a particular skill calibrated hybrid game, as recorded in their player account, determining a player's play and gambling performance for the purposes of marketing intelligence, and logging secondary drawing awards, tournament prizes, RWC and GWC into the player's account.

In many embodiments, the actual location of where various algorithms and functions are executed may be located either in the game contained devices (RWE, GWE, ESE), on the servers (RWE server, GWE server, or ESE server), or a combination of both. In particular embodiments, certain functions of a RWE server, GWE server, GW patron server or ESE server may operate on the local RWE, GWE or ESE contained with a skill calibrated hybrid game locally. In certain embodiments, a server is a server system including a plurality of servers, where software may be run on one or more physical devices. Similarly, in particular embodiments, multiple servers may be combined on a single physical device.

Figure 3:
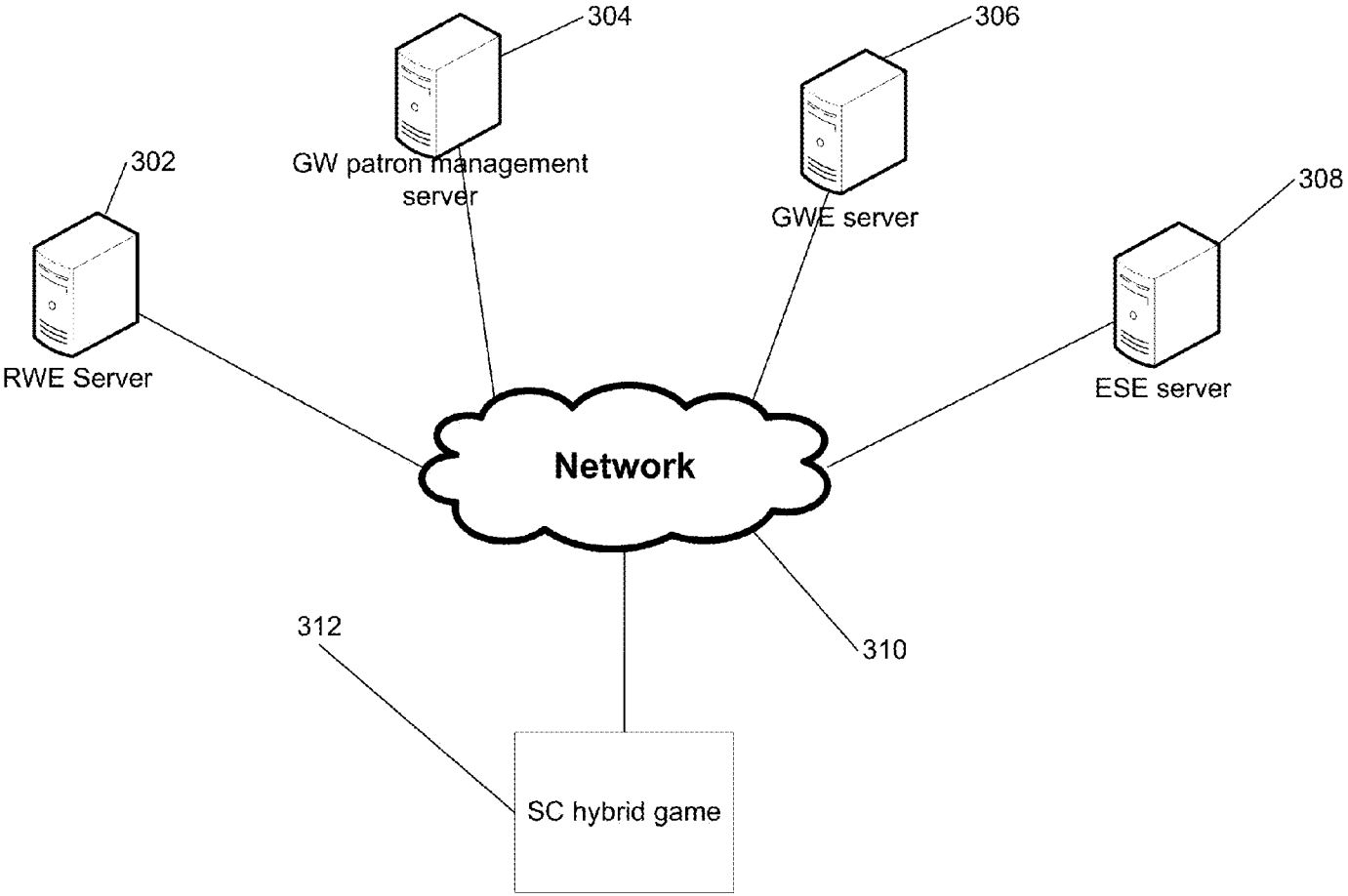
FIG. 3 is a system diagram that illustrates a network distributed skill calibrated hybrid game in accordance with an embodiment of the invention.

Skill calibrated hybrid games in accordance with many embodiments of the invention can be networked with remote servers in various configurations. A networked skill calibrated hybrid game in accordance with an embodiment of the invention is illustrated in FIG. 3. The networked skill calibrated hybrid game 312 is connected with a RWE server 302, GW patron management server 304, GWE server 306 and ESE server 308 over a network 310, such as (but not limited to) the Internet. Servers networked with a networked skill calibrated hybrid game 312 can also communicate with each of the components of a networked skill calibrated hybrid game and amongst the other servers in communication with the networked skill calibrated hybrid game 312.

Although various networked skill calibrated hybrid games are discussed above, networked skill calibrated hybrid games can be configured in any manner as appropriate to the requirements of a specific application in accordance with embodiments of the invention. Skill calibration modules capable of implementing the calibration of skill calibrated hybrid games are discussed below.

Skill Calibration Module

A skill calibration module in accordance with many embodiments of the invention can be integrated with a GWE to select or configure the characteristics of a gambling game, such as by calibrating the wager terms of a gambling game to a player's achievements or demonstrated skill level at the entertainment game. A skill calibration module can be integrated in conjunction with a GWE in any manner appropriate to the requirements of a specific application. In numerous embodiments, a skill calibration module can be part of a GWE. In other embodiments, a skill calibration module is a stand-alone module in communication with a GWE. In yet a further embodiment, a skill calibration module is housed in a centralized server or servers in communication with a GWE. In certain embodiments, a supervisory module can be networked to one or more skill calibrated hybrid games to monitor and accept the operation of a skill calibration module.

Figure 4:
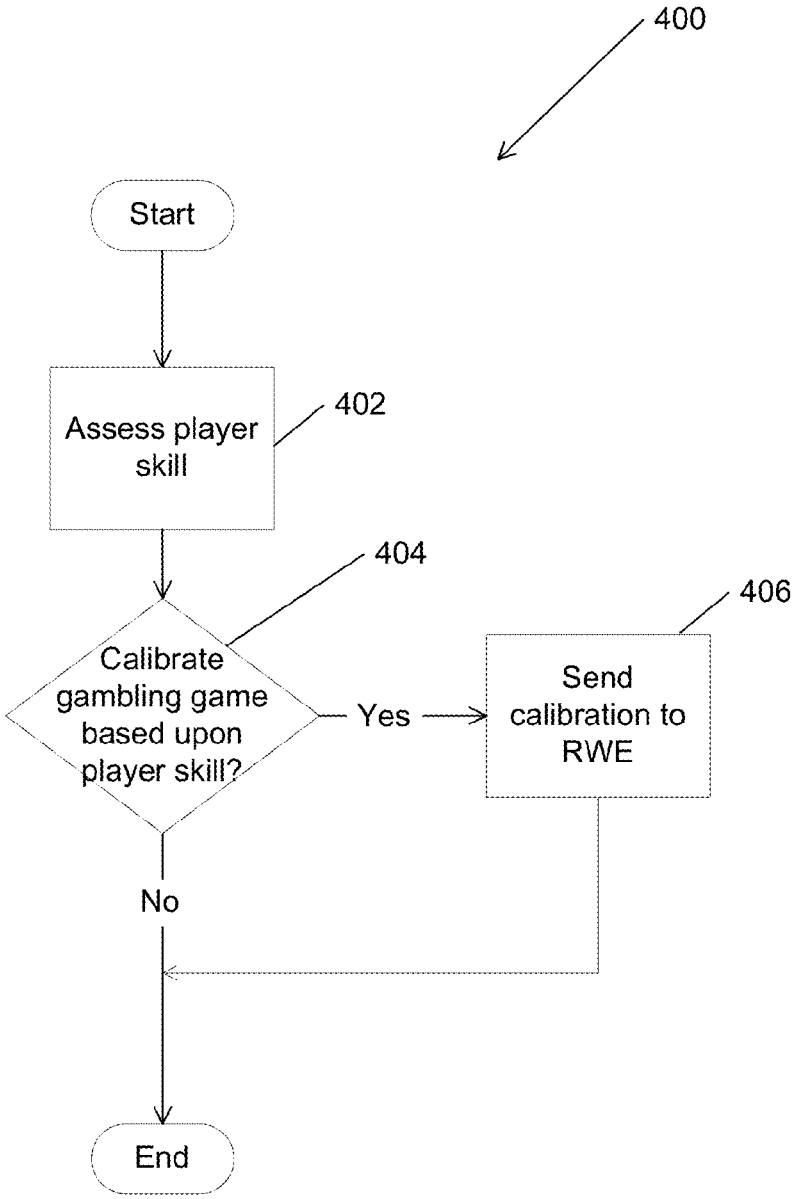
FIG. 4 is a flow chart of a process for calibrating a gambling game to a player's skill level in accordance with an embodiment of the invention.

A flow chart depicting an operational process of a skill calibration module in accordance with an embodiment of the invention is illustrated in FIG. 4. The process 400 includes assessing (402) a player's skill level based upon received data concerning a player's performance at an entertainment game. A determination (404) is then made as to whether wager terms in a gambling game should be calibrated to the determined player skill level. If the calibration of the gambling game is to be adjusted, then a command to calibrate the wager terms in the gambling game is sent (406) to the RWE and the process ends. If the current calibration of the gambling game does not require adjustment, then the process ends.

In numerous embodiments, a skill calibration module level module can store a record of calibrations or calibration history, which can be utilized during the execution of the entertainment game or the gambling game. In certain embodiments, a player's calibration history can be utilized in future decisions to calibrate the wager terms in a gambling game. In particular embodiments, a player's calibration history can be utilized in an entertainment game in decisions concerning (but not limited to) how payouts from a gambling game affect the entertainment game.

In many embodiments, a skill calibration module may identify relevant player achievements at the start of gameplay in order to generate a calibration. In some embodiments, a skill calibration module may dynamically change a calibration in response to game world events within the entertainment game or real world events within the gambling game. For instance, in a racing game, a skill calibration module may have target completion times for each race. When those times are bettered, the skill calibration module could trigger a change in the gambling game such as, but not limited to a larger potential payout or a better pay table.

Figure 5:
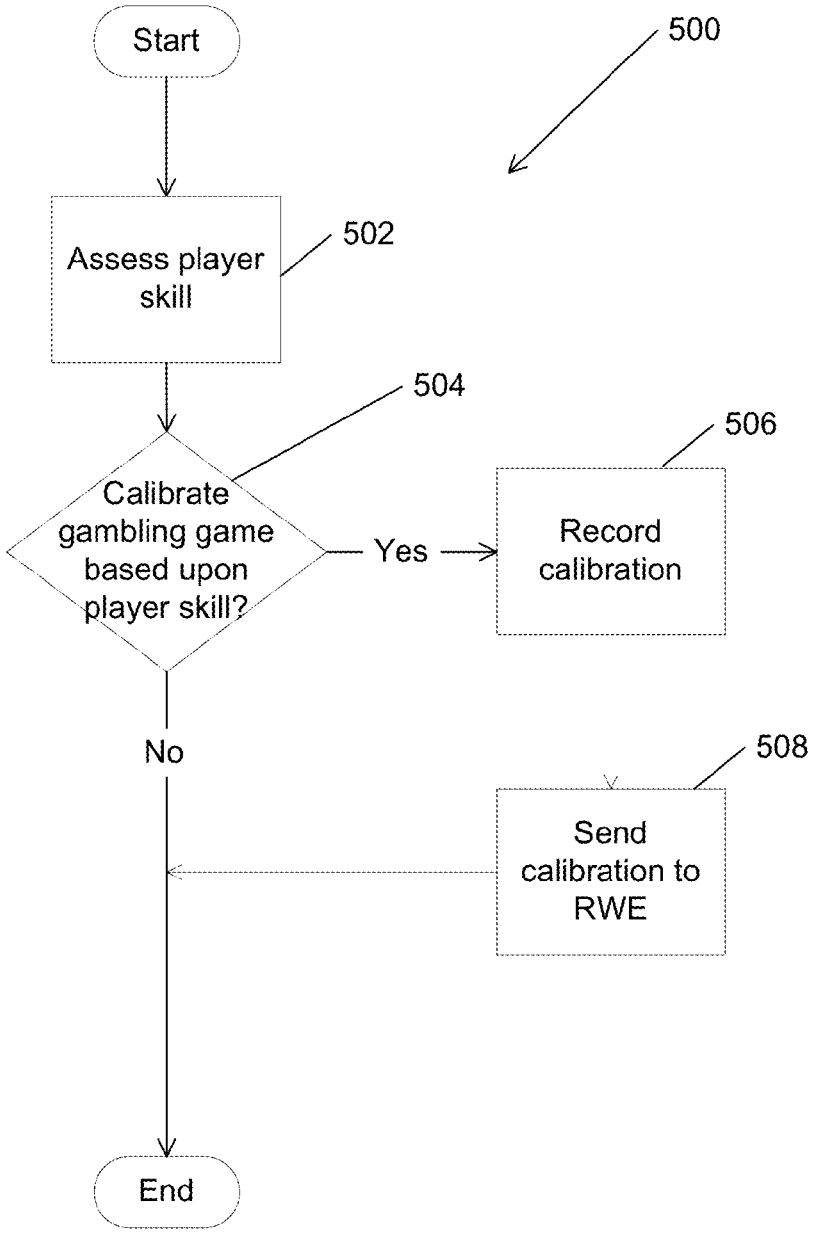
FIG. 5 is a flow chart of a process for calibrating a gambling game to a player's skill level and recording the calibration of a gambling game in accordance with an embodiment of the invention.

A process for adjusting calibration of a gambling game based upon a player's skill and/or a calibration history and recording the adjustment in a calibration history using a skill calibration module in accordance with an embodiment of the invention is illustrated in FIG. 5. The process 500 includes assessing (502) a player's skill level based upon received data concerning a player's performance at an entertainment game. In several embodiments, the determination of skill level can also utilize a calibration history and/or a record of recorded player skill for a particular player. A determination (504) is then made as to whether wager terms in a gambling game should be calibrated based upon factors including (but not limited to) the determined player skill level. When the calibration of the gambling game is adjusted, then the calibration adjustment is recorded (506) and a command to calibrate the wager terms in the gambling game is sent (508) to the RWE and the process ends. If no adjustment of the calibration of the gambling game is required, then the process can also end.

Although various skill calibration modules are discussed above, networked skill calibrated hybrid games can be integrated with skill calibration modules in any manner appropriate to the requirements of a specific application in accordance with embodiments of the invention. Methods of calibrating a skill calibrated hybrid game based upon a player's skill level are discussed below.

Methods of Calibrating a Skill Calibrated Hybrid Game

Skill calibrated hybrid games in accordance with many embodiments of the invention can calibrate wager terms in a gambling game to an assessed skill level of a player in an entertainment game. In various embodiments, the assessment of a player's skill level and a determination of how wager terms are to be calibrated are made by a GWE. The calibrations are then communicated to a RWE to implement in a gambling game. The communication between a GWE and a RWE may be monitored by an operator of the skill level gambling game and/or any other regulator of the skill calibrated hybrid game. In various embodiments, a GWE may identify relevant achievements to assess player skill level at the start of gameplay, or dynamically adjust achievements in the entertainment game indicative of player skill level in response to events that occur in the entertainment game or the gambling game.

In many embodiments, a GWE may evaluate demonstrated player skill level as a function a player's gameplay performance in the current session of entertainment game play (such as but not limited to over an entire session or in the context of a single recent achievement or action), or measure a player's skillful execution of the entertainment game over time (such as but not limited to across multiple game sessions associated with a player's profile or account).

In numerous embodiments, player performance information is information concerning a player's performance at a skill calibrated hybrid game that is collected while a player plays a skill calibrated hybrid game. Player performance information can be used to assess a player's skill level. The types of player performance information that can be collected while a player plays a skill calibrated hybrid game include but is not limited to: an amount or rate of real world credit committed by a player in a gambling game of the skill calibrated hybrid game while playing an entertainment game of the skill calibrated hybrid game; an amount or rate of utilization or restoration of an enabling element or actionable element; an amount or rate of accrual or loss of real world credits or game world credits; an amount or rate of accrual or loss of game world objects; advancement or rate of advancement of the player through the entertainment game; an amount or rate of utilization of a game resource; an amount or rate of accrual or loss of a game resource; or an amount or rate of accrual or loss of a game performance indicator including but not limited to skill points, bosses defeated, or non-player characters defeated and levels achieved.

In several embodiments, a determination of a player's skill level because of gameplay performance can consider the player's utilization of gaming resources while playing the skill calibrated hybrid game. In certain embodiments, as a player plays the entertainment game of the skill calibrated hybrid game, the player can also commit RWC wagers in the gambling game portion of the skill calibrated hybrid game as triggered by the player's actions such as, but not limited to, the consumption of EE. Therefore, information concerning amounts of RWC committed and won, as well as amounts of EE consumed and returned during the play of skill calibrated hybrid game may be used to determine a player's skill level.

In some embodiments, various types or items of a player's performance information may be combined with each other or used as comparisons in order to generate a metric of player performance that can be used to determine a player's skill level. In certain embodiments, ratios between amounts or rates of utilization, accrual or loss of various types of player performance information can be utilized to determine a player's skill level. These ratios include, but are not limited to: a rate of game world credit accrual or loss to a rate of real world credit commitment, loss or accrual; an amount of game world credit accrued or lost to an amount of real world credit committed, accrued or lost; or a level or rate of entertainment game achievement to an amount or a rate of real world credit commitment, loss or accrual.

In certain embodiments utilizing a racing game, a GWE may utilize player performance information as target completion times for each race from which to assess player skill level. A player whose race results fall below or above the target completion times for each race can trigger a calibration of the wager terms of the gambling game such as (but not limited to) a smaller or larger wager and/or potential payout or a change in the frequency at which a wager is initiated.

In several embodiments, an operator of a skill calibrated hybrid game may set a minimum skill level that a player must demonstrate before a gambling game's wager terms are calibrated, allowing players to become familiar with the entertainment game before the gambling game is adjusted.

In a number of embodiments, calibration of wager terms made in a gambling game can be consistent for all players playing the same skill calibrated hybrid game, or may be different for each player as a function of their demonstrated skill level. The influence of skill level can also be dynamically adjusted during gameplay in response to an evaluation of the player's performance at the entertainment game. The achievements available in an entertainment game may also vary as a function of player skill. In certain embodiments with a shooting type entertainment game there may be an achievement based on accuracy. The degree of accuracy necessary for an achievement may be based on the level at which a player's skill level is assessed. Players whose player accounts are associated with high skill level can be required to shoot with 85% accuracy while a player whose player accounts are associated with an intermediate skill level can be required to shoot with 70% accuracy. Successful achievement of these requirements can trigger a change in the terms of a wager made in a gambling game.

In numerous embodiments, calibration of the wager terms can be made in any manner such as but not limited to by scaling wagers based upon the skill level of a player or increasing or decreasing the odds, range of possible outcomes, amount wagered, and frequency of wagers or availability of bonus rounds. In various embodiments, the calibration of wager terms in the gambling game can be performed along a scale where the effect of player skill level can be arbitrarily magnified or reduced. In certain embodiments, a base wager in the gambling game can be 10 credits. However, a player's skill level can allow a player to wager the base wager of 10 credits+/−nX, where X is skill level and n is the factor by which an operator allows modification. Although the above calibration is a linear calibration, any of a variety of linear and/or non-linear calibrations can be utilized appropriate to the requirements of a specific hybrid gaming application in accordance with embodiments of the invention. In embodiments that employ a shooting type of entertainment game, player performance information can include the accuracy with which a player skillfully aims at targets. That player performance information can be used to assess a player's skill level and calibrated to have a small or large amount of impact on the terms of a wager in the gambling game.

Although various methods for calibrating wager terms in a gambling game to the skill level of a player in an entertainment game are discussed above, skill calibrated hybrid games can be calibrated in any manner appropriate to the requirements of a specific application in accordance with embodiments of the invention. Skill calibrated hybrid games that interact with players concerning the ongoing calibration of a skill calibrated hybrid game in accordance with embodiments of the invention are discussed further below.

Player Interaction with Skill Calibrated Hybrid Games

Players in accordance with many embodiments of the invention can interact with the skill calibrated hybrid game to accept or not accept calibration applied to a gambling game. In numerous embodiments, a skill calibrated hybrid game must first receive an indication that a player has accepted of the calibration of wager terms prior to the skill calibrated hybrid game applying the calibrated wager terms to a hybrid game. In various embodiments, a skill calibrated hybrid game can communicate a notification that the wager terms in a gambling game are about to be calibrated to a player's skill level in an entertainment game user interface. The skill calibrated hybrid game can wait for an affirmative indication from the entertainment game's user interface that a player accepts or does not accept the calibration of wager terms to the player's skill level. If the skill calibrated hybrid game receives an indication that the player accepts the calibration, then the wager terms in a gambling game are applied.

In certain embodiments, receipt of an indication of a player's rejection of the calibration of wager terms from the entertainment game user interface can cause the skill calibrated hybrid game to end the gameplay session. In particular embodiments, gameplay can continue and the calibration is not applied after the skill calibrated hybrid game receives notice of a player's failure to accept the calibration of wager terms. In various embodiments, a skill calibrated hybrid game can communicate a notification in an entertainment game user interface that the skill calibrated hybrid game has determined that a player is at a high skill level. The skill calibrated hybrid game can then inform the player that it is about to calibrate the wager terms in the entertainment game to reflect that high skill level with increased stakes in the entertainment game user interface. If the skill calibrated hybrid game receives an indication through the entertainment game user interface that the player accepts the calibration, the skill calibrated hybrid game executes as before. If the skill calibrated hybrid game receives an indication from the entertainment game user interface that the player does not accept the calibration, the skill calibrated hybrid game can end a current gameplay session.

In numerous embodiments, a receipt of a player's failure to accept a calibration of wager terms in a gambling game to the player's skill level from the entertainment game user interface can affect the characteristics of the entertainment game. In certain embodiments, an entertainment game user interface may communicate that a player being assessed to have a low skill level will cause the wager terms in the gambling game to be calibrated to the low skill level by a reduction in the amount to be wagered per occurrence of an actionable event (AE). If the user interface receives a notification that the player accepts the calibration, the gameplay session continues as before with the calibration applied. If the user interface receives a notification that the player does not accept the calibration, the opportunity for AEs to transpire can be reduced to decrease the rate at which wagers are placed in the RWE.

Figure 6:
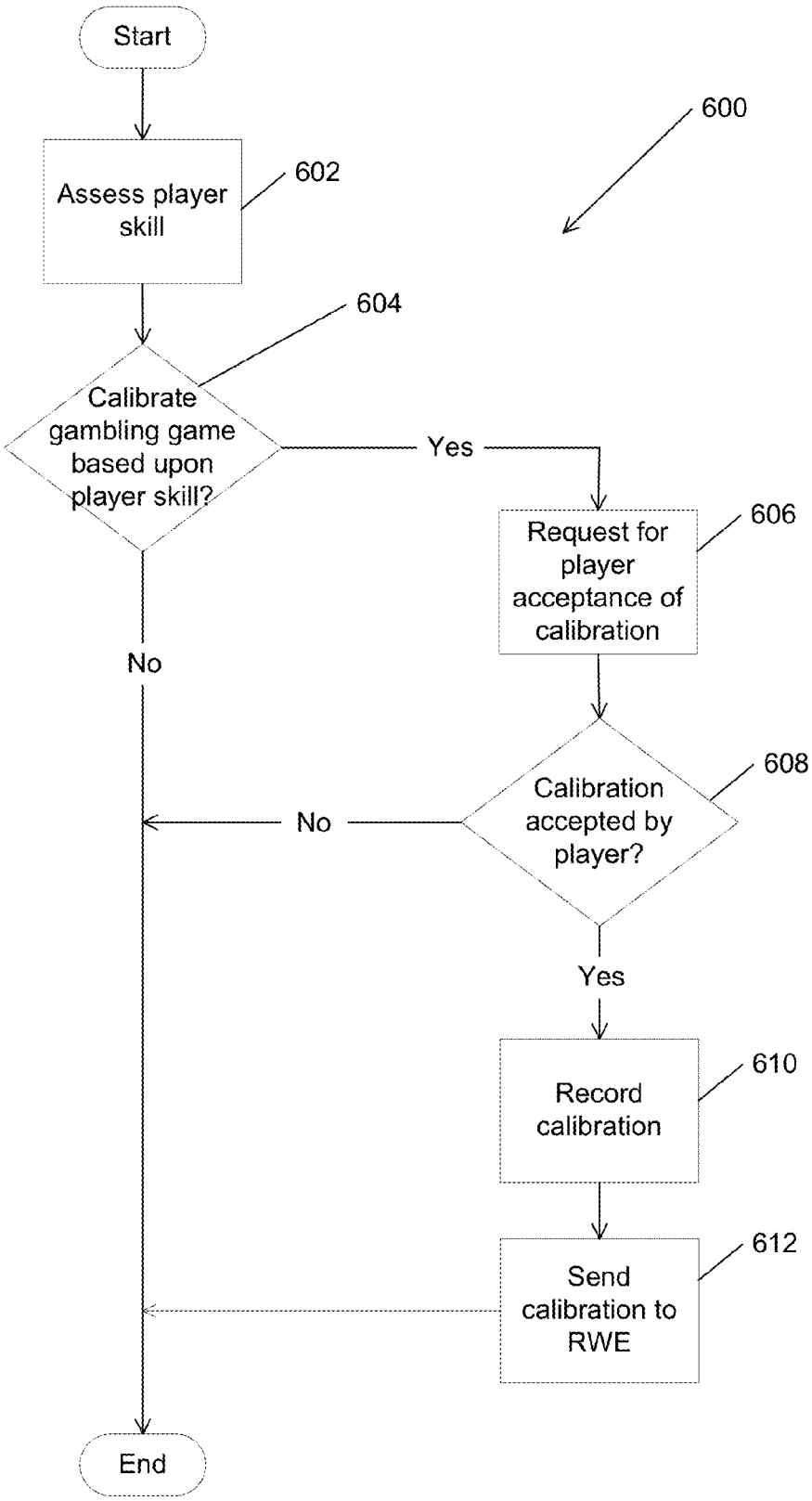
FIG. 6 is a flow chart of a process by which calibration of a gambling game occurs after player acceptance in accordance with an embodiment of the invention.

A flow chart depicting an operational process of a skill calibration module where player interaction determines whether calibration is applied in accordance with an embodiment of the invention is illustrated in FIG. 6. The process 600 includes assessing (602) a player's skill level based upon received data concerning a player's performance at an entertainment game. A determination (604) is then made as to whether to adjust the calibration of wager terms in a gambling game based upon the determined player skill level. If adjustment of the calibration of the wager terms of the gambling game is not required, then the process ends. If a determination is made that an adjustment to the calibration of the wager terms of the gambling game is made, then a request (606) for acceptance of the calibration is made within a user interface of the skill calibrated hybrid game. After the request for acceptance, a determination (608) is made as to whether the player has accepted the calibration from the user interface. If an indication that the player has accepted the calibration is received by the user interface, then the calibration is recorded (610), a command to calibrate the wager terms in the gambling game is sent (612) to the RWE and the process ends. If the player does not accept the calibration, then the process ends.

Although various ways in which a player can interact with a skill calibrated hybrid game is discussed above, players can interact with skill calibrated hybrid games in any manner as appropriate to the requirements of a specific application in accordance with embodiments of the invention. Processing apparatuses which can be used to implement skill calibrated hybrid games are discussed below.

Processing Apparatus

Figure 7:
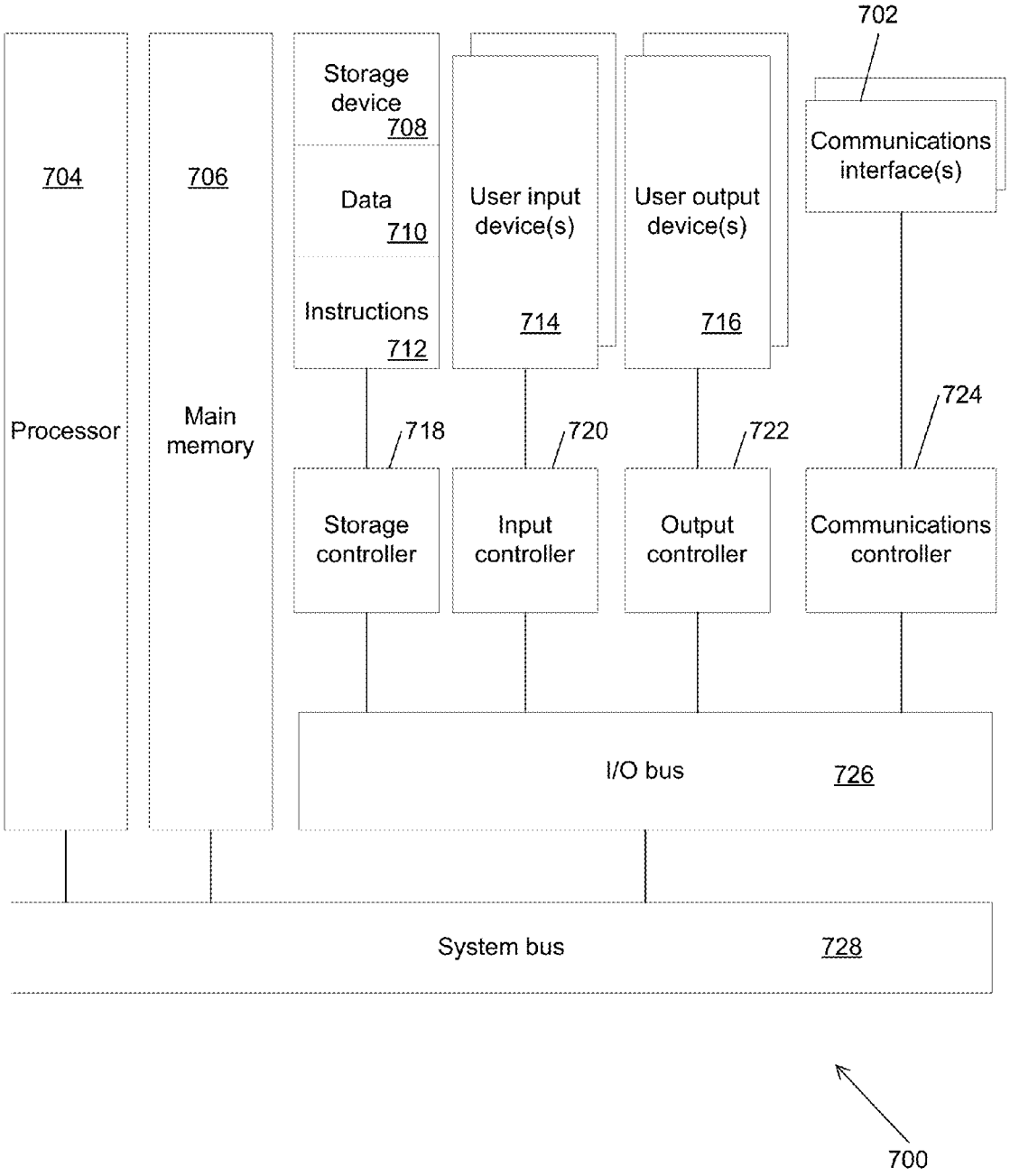
FIG. 7 illustrates a hardware architecture diagram of a processing apparatus utilized in the implementation of a skill calibrated hybrid game in accordance with an embodiment of the invention.

Any of a variety of processing apparatuses can host various components of a skill calibrated hybrid game in accordance with embodiments of the invention. In several embodiments, these processing apparatuses can include, but are not limited to, a gaming machine, a general purpose computer, a computing device and/or a controller. A processing apparatus that is constructed to implement a skill calibrated hybrid game in accordance with an embodiment of the invention is illustrated in FIG. 7. In the processing apparatus 700, a processor 704 is coupled to a memory 706 by a bus 728. The processor 704 is also coupled to non-transitory processor-readable storage media, such as a storage device 708 that stores processor-executable instructions 712 and data 710 through the system bus 728 to an I/O bus 726 through a storage controller 718. The processor 704 is also coupled to one or more interfaces that may be used to connect the processor to other processing apparatuses as well as networks as described herein. The processor 704 is also coupled via the bus to user input devices 714, such as tactile devices including but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 704 is connected to these user input devices 714 through the system bus 728, to the I/O bus 726 and through the input controller 720. The processor 704 is also coupled via the bus to user output devices 716 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 728 to the I/O bus 726 and through the output controller 722. The processor 704 can also be connected to a communications interface 702 from the system bus 728 to the I/O bus 726 through a communications controller 724.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, GWE or ESE as described herein can be implemented on multiple processing apparatuses, whether dedicated, shared or distributed in any combination thereof, or may be implemented on a single processing apparatus. In addition, while certain aspects and features of element management processes described herein have been attributed to an RWE, GWE, or ESE, these aspects and features may be implemented in a hybrid form where any of the features or aspects may be performed by any of a RWE, GWE, ESE within a skill calibrated hybrid game without deviating from the spirit of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A system for a skill calibrated hybrid game, comprising:

a game world engine constructed to:

couple to a real world engine constructed to provide a randomly generated payout of real world credits from a wager in a gambling game;

couple via a network to an entertainment software engine constructed to execute an entertainment game providing outcomes based upon a player's skillful execution of the entertainment game; and manage the entertainment software engine and communicate gameplay gambling event occurrences based upon the player's skillful execution of the entertainment game that trigger the wager in the gambling game to the gambling game; and a skill calibration module coupled to the game world engine, the skill calibration module constructed to:

receive player performance information for the player from the game world engine, where the player performance information is indicative of the player's gameplay performance at the entertainment game;

analyze the player performance information to determine a player's skill level in playing the entertainment game;

determine whether the terms of the wager of the gambling game are calibrated in a manner appropriate to the player's skill level in the entertainment game; and send a command to the real world engine during play of the skill calibrated hybrid game that causes the real world engine to calibrate the terms of the wager in the gambling game.

2. The system for a skill calibrated hybrid game of claim 1, wherein the skill calibration module is constructed to record adjustments to the calibration of the terms of the wager in the gambling game in a calibration history.

3. The system for a skill calibrated hybrid game of claim 2, wherein the information relating to calibrating the terms of the wager in the gambling game includes metadata that enables the information to be utilized in a future determination of the appropriate calibration for the terms of the wager of the gambling game.

4. The system for a skill calibrated hybrid game of claim 1, wherein the command to calibrate the terms of the wager is sent only when notification that the player that the calibration is applied to accepts the calibration is received by an entertainment game user interface.

5. The system for a skill calibrated hybrid game of claim 1, wherein play of the skill calibrated hybrid game ends when notification that the player that the calibration is applied to does not accept the calibration is received by an entertainment game user interface.

6. The system for a skill calibrated hybrid game of claim 1, wherein the player performance information is analyzed during play of the hybrid game by the player in a session to determine the player's skill level during that session.

7. The system for a skill calibrated hybrid game of claim 1, wherein the real world engine is constructed to communicate with the game world engine via the network.

8. The system for a skill calibrated hybrid game of claim 1, wherein the terms of the wager are calibrated such that more wagers are performed for a given period of time for a higher skilled player than for a lower skilled player.

9. The system for a skill calibrated hybrid game of claim 1, wherein the terms of the wager are calibrated such that more real world credits are wagered per wager for a higher player skill level than for a lower player skill level.

10. The system for a skill calibrated hybrid game of claim 9, wherein the terms of the wager are calibrated by adding an amount of real world credits that is a multiple of a discrete number that represents the player's skill level to an amount of real world credits wagered in each wager.

11. A method of operating a system for a skill calibrated hybrid game, the method comprising:

coupling by a game world engine to a real world engine constructed to provide a randomly generated payout of real world credits from a wager in a gambling game;

coupling by the game world engine via a network to an entertainment software engine constructed to execute an entertainment game providing outcomes based upon a player's skillful execution of the entertainment game;

managing by the game world engine the entertainment software engine;

determining by the game world engine gameplay gambling event occurrences based upon the player's skillful execution of the entertainment game that trigger the wager in the gambling game;

communicating by the game world engine to the gambling game the gambling event occurrences;

coupling by the game world engine to a skill calibration module coupled, the skill calibration module;

receiving by the skill calibration module player performance information for the player from the game world engine, where the player performance information is indicative of the player's gameplay performance at the entertainment game;

analyzing by the skill calibration module player the player performance information to determine a player's skill level in playing the entertainment game;

determining by the skill calibration module whether the terms of the wager of the gambling game are calibrated in a manner appropriate to the player's skill level in the entertainment game; and sending by the skill calibration module a command to the real world engine during play of the skill calibrated hybrid game that causes the real world engine to calibrate the terms of the wager in the gambling game.

12. The method of claim 11, wherein the skill calibration module is constructed to record adjustments to the calibration of the terms of the wager in the gambling game in a calibration history.

13. The method of claim 12, wherein the information relating to calibrating the terms of the wager in the gambling game includes metadata that enables the information to be utilized in a future determination of the appropriate calibration for the terms of the wager of the gambling game.

14. The method of claim 11, wherein the command to calibrate the terms of the wager is sent only when notification that the player that the calibration is applied to accepts the calibration is received by an entertainment game user interface.

15. The method of claim 11, wherein play of the skill calibrated hybrid game ends when notification that the player that the calibration is applied to does not accept the calibration is received by an entertainment game user interface.

16. The method of claim 11, wherein the player performance information is analyzed during play to determine a player's skill level.

17. The method of claim 11, wherein the terms of the wager are calibrated such that more wagers are performed for a given period of time for a higher skilled player than for a lower skilled player.

18. The method of claim 11, wherein the terms of the wager are calibrated such that more real world credits are wagered per wager for a higher player skill level than for a lower player skill level.

19. The method of claim 18, wherein the terms of the wager are calibrated by adding an amount of real world credits that is a multiple of a discrete number that represents at least one player's skill level to the amount of real world credits wagered in each wager.

20. A non-transitory machine readable medium containing processor instructions, where execution of the instructions by one or more processors cause the one or more processors to perform a process of operating a system for a skill calibrated hybrid game, the process comprising:

coupling by a game world engine to a real world engine constructed to provide a randomly generated payout of real world credits from a wager in a gambling game;

coupling by the game world engine via a network to an entertainment software engine constructed to execute an entertainment game providing outcomes based upon a player's skillful execution of the entertainment game;

managing by the game world engine the entertainment software engine;

determining by the game world engine gameplay gambling event occurrences based upon the player's skillful execution of the entertainment game that trigger the wager in the gambling game;

communicating by the game world engine to the gambling game the gambling event occurrences;

coupling by the game world engine to a skill calibration module coupled, the skill calibration module;

receiving by the skill calibration module player performance information for the player from the game world engine, where the player performance information is indicative of the player's gameplay performance at the entertainment game;

analyzing by the skill calibration module player the player performance information to determine a player's skill level in playing the entertainment game;

determining by the skill calibration module whether the terms of the wager of the gambling game are calibrated in a manner appropriate to the player's skill level in the entertainment game; and sending by the skill calibration module a command to the real world engine during play of the skill calibrated hybrid game that causes the real world engine to calibrate the terms of the wager in the gambling game.

* * * * *